US007051670B2

(12) United States Patent
Santandrea et al.

(10) Patent No.: US 7,051,670 B2
(45) Date of Patent: May 30, 2006

(54) EQUIPMENT FOR PREPARING FOR ELECTROSTATIC PAINTING THREE-DIMENSIONAL ARTICLES WITH A PREDOMINANTLY FLAT EXTENSION

(75) Inventors: Silver Santandrea, Imola (IT); Stefano Benedetti, Borgo Tossignano (IT)

(73) Assignee: CEFLA Soc. Coop. a.r.l. (IT)

( * ) Notice: Subject to any disclaimer, the term of this patent is extended or adjusted under 35 U.S.C. 154(b) by 20 days.

(21) Appl. No.: 10/628,365

(22) Filed: Jul. 29, 2003

(65) Prior Publication Data

US 2004/0237887 A1 Dec. 2, 2004

(30) Foreign Application Priority Data

Aug. 7, 2002 (IT) ..... BO2002A0524
Apr. 24, 2003 (IT) ..... BO2003A0243

(51) Int. Cl.
*B05C 5/02* (2006.01)
*B05C 13/00* (2006.01)

(52) U.S. Cl. ..... 118/50.1; 118/620; 118/621; 118/629; 118/308; 118/500; 198/688.1; 198/691; 271/193

(58) Field of Classification Search ..... 118/50.1, 118/620, 621, 629, 500, 308; 198/691, 688.1; 271/193

See application file for complete search history.

(56) References Cited

U.S. PATENT DOCUMENTS 3,770,482 A * 11/1973 Millar et al. ..... 427/470
4,244,465 A * 1/1981 Hishikawa et al. ..... 198/691
4,836,137 A * 6/1989 Heine et al. ..... 118/663
4,901,666 A * 2/1990 Nagasaka et al. ..... 118/634

FOREIGN PATENT DOCUMENTS

EP 1 243 340 9/2002
WO WO 01/85357 11/2001

* cited by examiner

*Primary Examiner*—Laura Edwards
(74) *Attorney, Agent, or Firm*—Stites & Harbison PLLC; Marvin Petry

(57) ABSTRACT

The equipment for preparing for electrostatic painting three-dimensional articles (P) with a predominantly flat extension, made from dielectric or low-conductivity material, which move on and are supported by a horizontal conveyor (T), presents the feature that the conveyor is made from an electrically insulating material, having a resistivity greater than that of the panels (P) to be painted. One or more electrodes (E, 12) are placed in isolated positions, at suitable distances from each other and from the edges of the panels, under the said panels, at least while the powdered paints electrostatically charged to an electrical potential are being fed on to them. The electrodes emit an electrical field with characteristics such that it charges the whole visible surface of the said panels, as far as their area of contact with the conveyor, to an electrical potential of opposite sign to that of the powdered paints, in such a way that the powdered paints completely and uniformly cover the said visible surface of the panels.

62 Claims, 7 Drawing Sheets

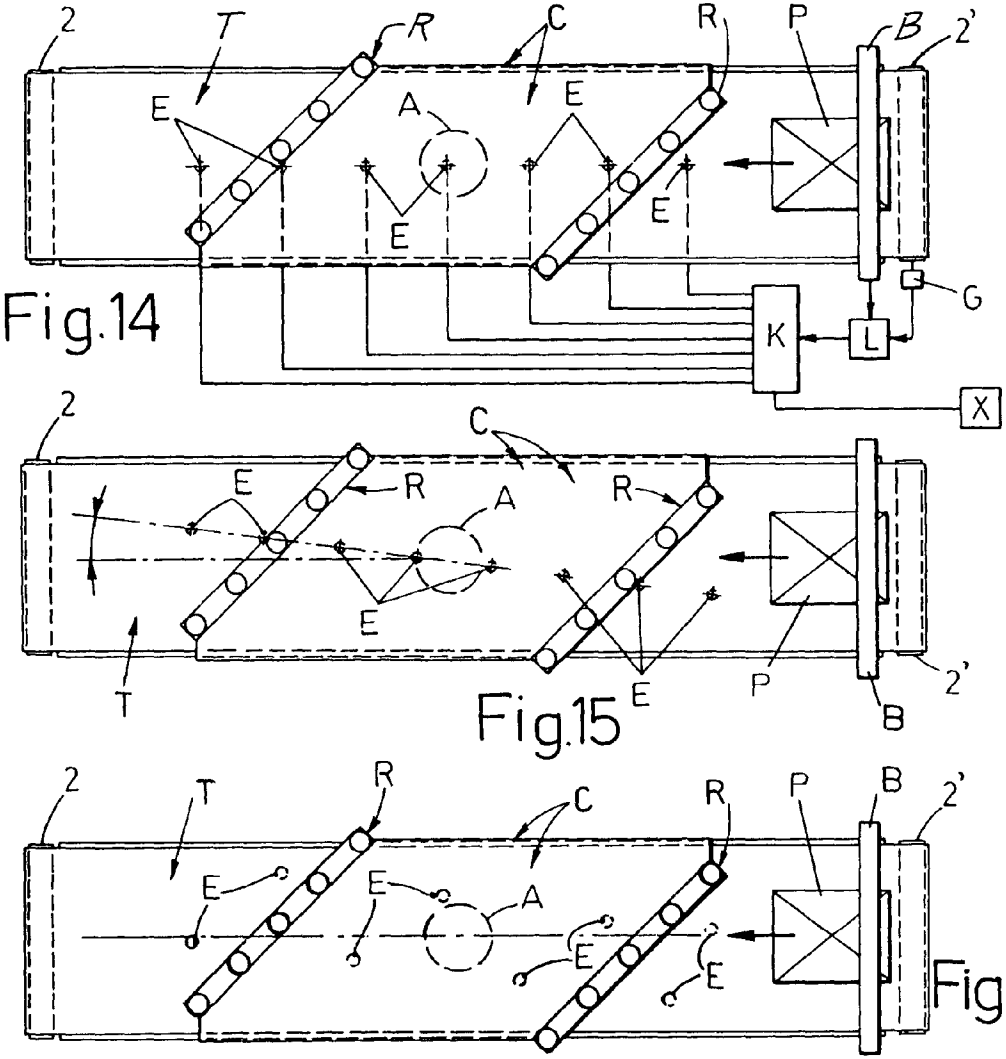
Fig.14
Fig.15
Fig.16
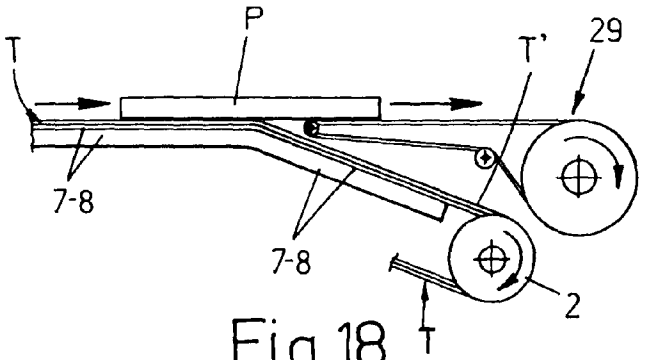
Fig.18
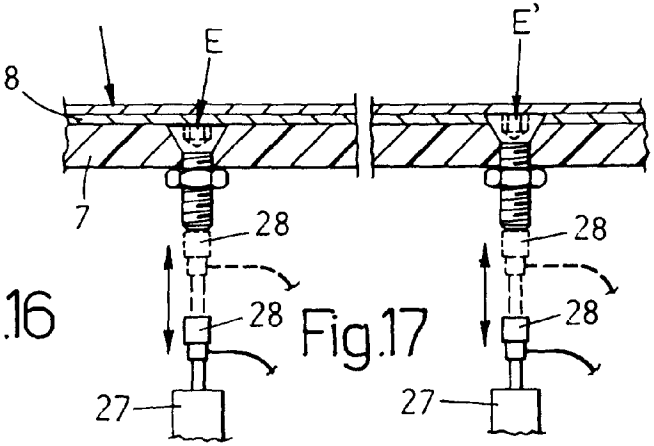
Fig.17

EQUIPMENT FOR PREPARING FOR ELECTROSTATIC PAINTING THREE-DIMENSIONAL ARTICLES WITH A PREDOMINANTLY FLAT EXTENSION

The invention relates to machines for the electrostatic painting of three-dimensional articles having a predominantly flat extension, which are normally panels, made from dielectric or low-conductivity material, normally wood or wood derivatives, for example MDF, which move on and are supported by a horizontal conveyor, on which the said panels are charged to an electrical potential of opposite sign to that of the paint powders fed by the electrostatic guns into a chamber which is kept at negative pressure by suitable means. Machines of this type are described, for example, in documents WO 01/85357 A1 and EP 1 243 340 A2 (corresponding to U.S. application Ser. No. 10/101,845), to which the most wide-ranging reference will be made. In the first type of machine, the conveyor on which the panels move is made from electrically conductive material and comprises means for raising at least the upper run of the said conveyor to a specified electrical potential, for example a negative potential, with respect to earth, in such a way that the articles to be painted are also at this potential and can be painted on their visible surfaces by the paint powders fed into the paint chamber by the electrostatic guns which charge the said paints, to a positive potential for example. This solution has proved to be unsuitable for ensuring the electrostatic charging to a sufficiently and uniformly distributed electrical potential of the surfaces to be painted of articles with very low electrical conductivity, the main problems being encountered on the edges of the panels and particularly in their areas of contact with the conveyor, as if these areas were in electrostatic equilibrium or positively charged. In order to overcome this problem, the second of the aforesaid machines used a conveyor made of synthetic, and therefore electrically insulating, materials, having at least an outer surface which was a good conductor of electrical charges and using an electrostatic charging bar positioned transversely above and at an appropriate distance from the upper run of the said conveyor, and orientated with its points downwards, in such a way as to distribute electrical charges, of negative polarity for example, over the panel and over the conveyor passing beneath it, to charge them electrostatically with a specified polarity and intensity and in a uniformly distributed way before the conveyor and panel enter the paint chamber. This solution has also failed to provide the desired results on panels having very high resistivity, problems of coverage again being encountered at the edges of the panels and particularly in the areas of contact between the edges of the panels and the conveyor.

In various experiments conducted with the aim of overcoming the problem, the following solution yielded the desired results. The panel was placed on a surface made from an electrically insulating material, with a resistivity greater by at least one order of magnitude than that of the panel to be painted. Good results were obtained, for example, by using a porous polyethylene mat, such as one of the type used as a barrier in fluid beds, which is permeable to air but not to the paint powders, and which therefore incorporates air in its pores and consequently has an electrical behaviour very similar to that of air. A metallic electrode, connected to an electrically insulated conducting wire which passed through the mat and was connected to a source of negative electrostatic charges, was placed in a sufficiently centred position under the panel which rested on the insulating mat. The panel was then sprayed with paint powder charged positively by the electrostatic gun, and the result was surprising. The visible surface of the panel was covered completely and uniformly by the paint, even on the edges and in the areas of contact with the conveyor belt which had an unpainted area around the panel, in which the action of the electrical field generated by the electrode presumably ceased. It was subsequently found that the results deteriorated markedly if the electrode was very close to or very distant from one edge of the panel, and also in relation to the height of the said edge. If the panel was of considerable size in plan view, it could be acted on simultaneously by a plurality of electrodes, provided that these were positioned at sufficient distances from each other and from the perimeter of the said panel.

Three possible ways of implementing the aforesaid solution on an industrial scale were identified. The electrodes can be positioned under the upper run of the conveyor and can be operated selectively according to the dimensions of the panels to be painted. In another solution, the electrodes are again under the active run of the conveyor and are mounted in a movable way on means which enable the said electrodes to follow the panel during the painting and to be connected selectively to a fixed polarization source. Finally, in another solution the electrodes are embedded in the conveyor, in such a way that their upper ends are very close to the panel or directly in contact with it, so that they accompany it in its movement and interact selectively, by means of their lower ends or by means of an electrical conductor associated with them, with a fixed or movable polarisation collector. Further characteristics of the invention and the advantages derived therefrom will be made clear by the following description of some preferred embodiments of the invention, illustrated purely by way of example and without restrictive intent in the figures of the attached sheets of drawings, in which:

FIG. 1 shows schematically the method of constructing the conveyor and positioning the electrode in relation to the panel to be painted;

FIGS. 2, 3, 4 and 2*a*, 3*a*, 4*a* show schematically, in lateral elevation and in plan view respectively, the same number of other possible embodiments of equipment for the practical application of the method of FIG. 1;

FIGS. 14, 15 and 16 are plan views from above of the same number of different embodiments of a painting machine with fixed electrodes;

FIG. 17 is a lateral view, in partial section, of the details of the positioning of the polarization electrodes of the machine shown in FIGS. 14 to 16;

FIG. 18 is a lateral view of a possible embodiment of the terminal part of the panel movement conveyor in the machine with fixed electrodes.

Figure 1:
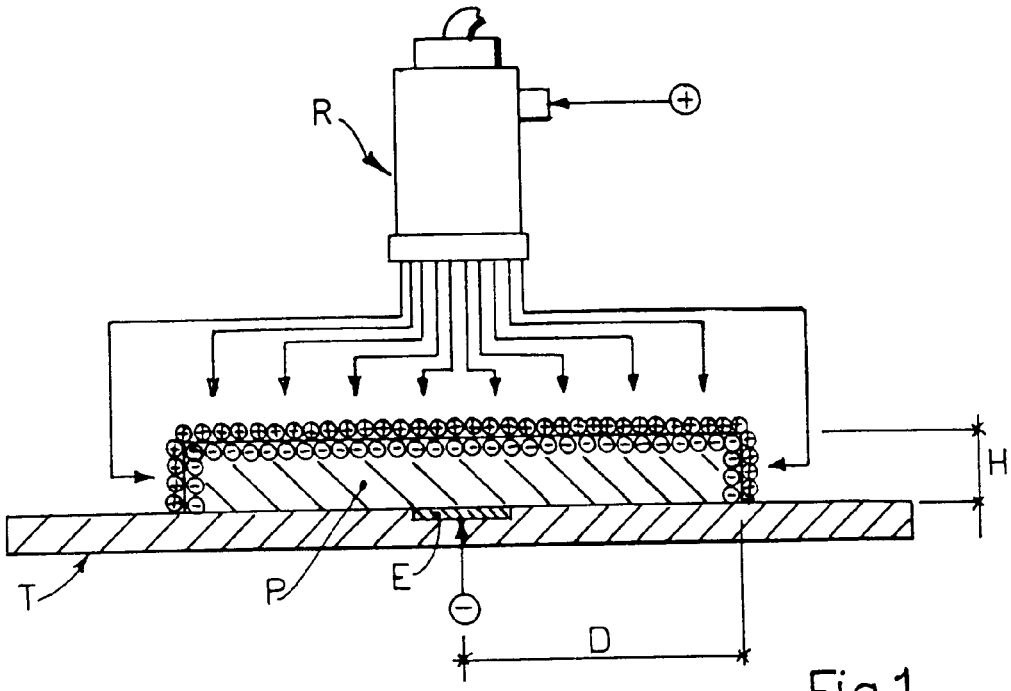

FIG. 1 shows how, according to the invention, the conveyor T, which supports the panels P to be painted, is to be constructed from any material or set of materials having characteristics of electrical insulation, having at least in the area in contact with the panel P an electrical resistivity which exceeds that of the said panel (e.g. 1011) by at least one order of magnitude (e.g. 1012). All the supporting and guiding parts of the conveyor T are obviously earthed as in the prior art. The conveyor T can be made wholly or partially from polyethylene and preferably from a material which is sufficiently porous to be permeable to air and not to paint, in other words in order to improve the resistivity of this material further, and also in order to enable pressurized air to be blown through the return run of the conveyor T to provide more thorough cleaning of the belt than that obtainable by the usual means of known types. This solution is not illustrated in the drawings since it is easily understood and can be implemented by persons skilled in the art on the basis of the explanations given previously. The thickness of the conveyor belt T can vary according to the positioning of the electrodes E, as described more fully below. Under the panel P there is positioned an electrode E of any suitable shape, connected to the source provided for the polarization, for example negative polarization, of the visible surface of the said panel on to which the paint powder is fed by the electrostatic guns R which charge the paint to a positive potential, so that it adheres completely and uniformly to the panel. It has been found that, in order to obtain the best results, the electrode E must be positioned at a distance D from the edges of the panel which is greater than 1–2 times the height H of the said panel and less than or equal to approximately 10 times the said height H. If the panel is of considerable size or has an elongate shape, it can be acted on simultaneously by a plurality of electrodes, provided that these are spaced apart by distances such that they do not interfere with each other, for example by distances of not less than approximately 10 times the height H of the edge of the panel. The electrode E can have any shape, for example round or square, or can be star-shaped with a plurality of points positioned in a flat arrangement or with a single point converging towards the panel, to exploit the shape of the electrical fields emitted by point electrodes. The electrodes E can be made from metal, from conducting rubber and/or from other materials suitable for the purpose.

Figure 2:
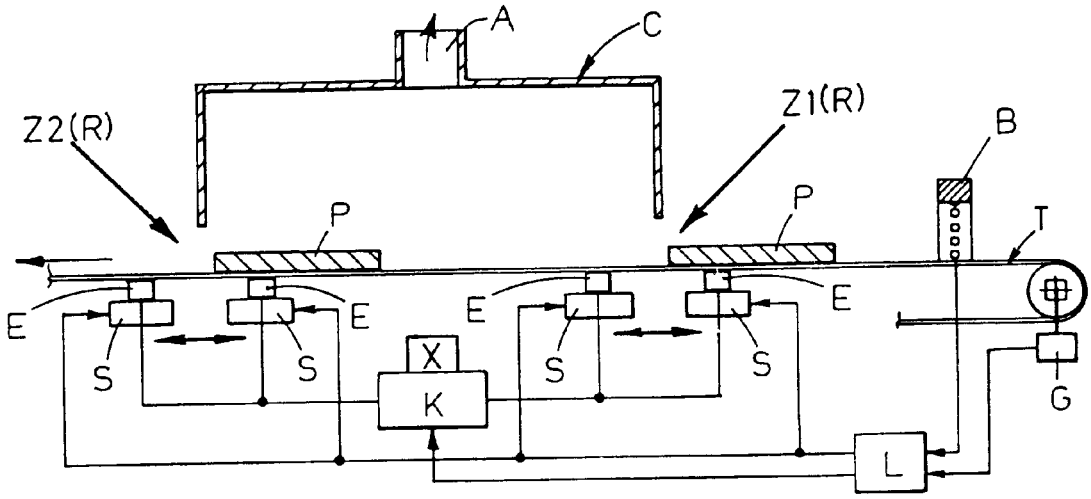
Figure 3:
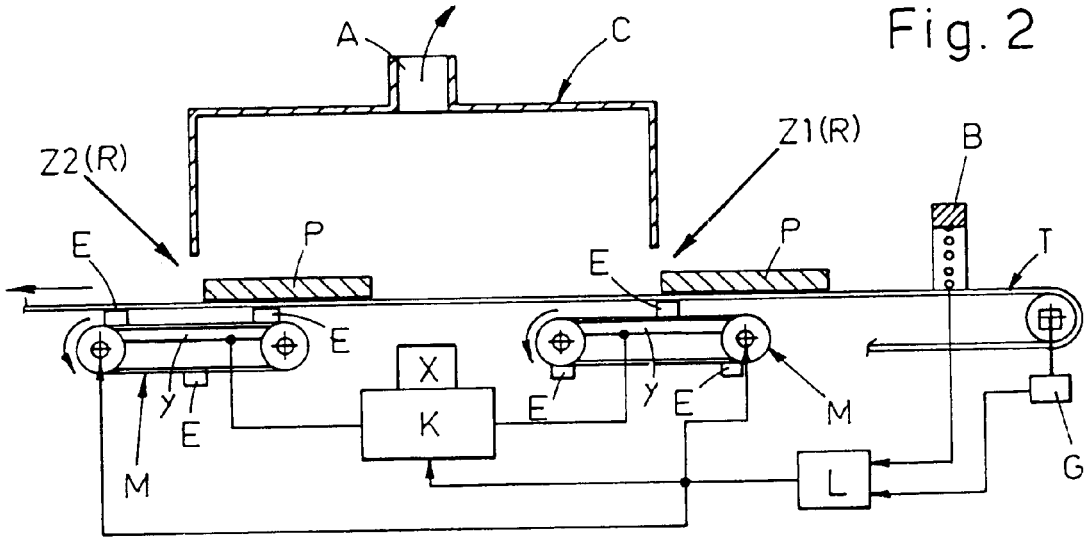
Figure 2A:
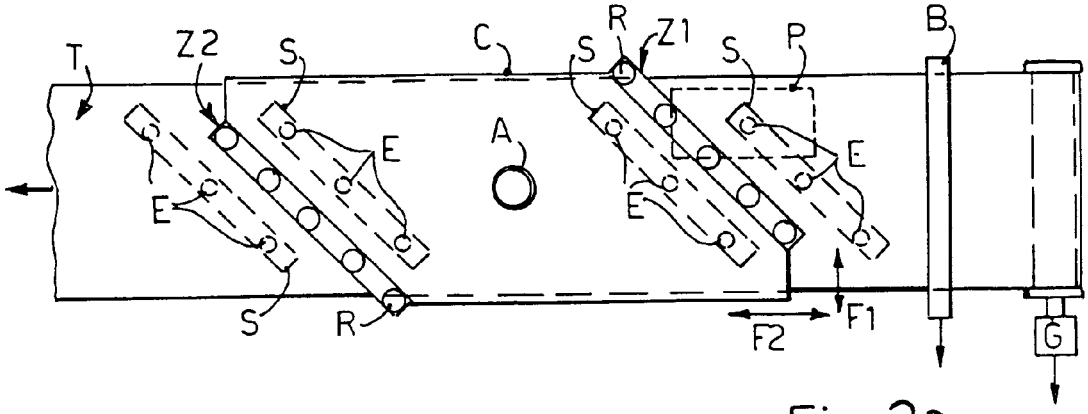
Figure 3A:
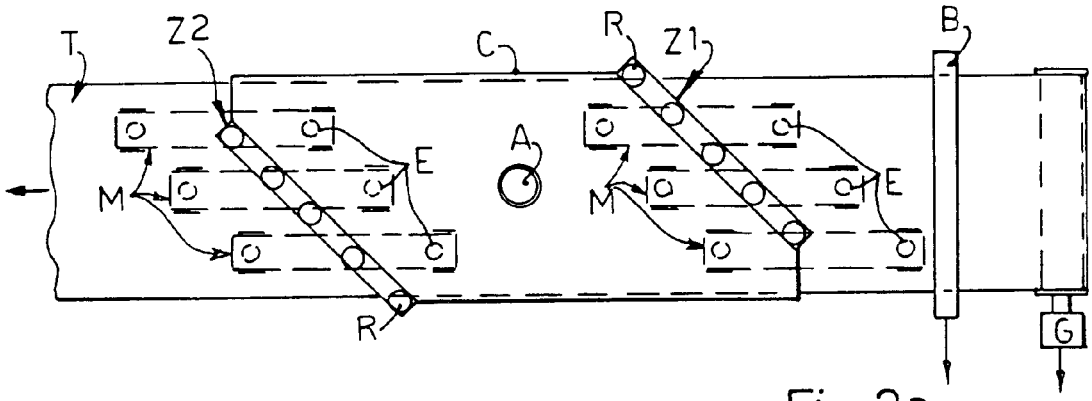

FIGS. 2 and 2*a* show schematically an electrostatic painting machine of the type referred to, having a horizontal conveyor belt T of the aforesaid type, whose upper run passes through a paint chamber C having at least one suction duct A and having entry and exit doors Z1 and Z2 which are, for example, oblique and staggered with respect to the transverse dimension of the belt T, near to which doors the guns R for feeding the paint powders operate. The electrodes E for the electrical polarization of the panels P to be painted are positioned under the upper run of the conveyor T which in this case will be made at least partially with a thickness such that the effects of the electrodes are not attenuated. The electrodes can be fixed and are connected to the electrical polarization source X through a switch unit K controlled by a processor L which receives from an encoder G the data relating to the speed of movement of the conveyor T and which receives from an optoelectronic barrier B the data relating to the shape and dimensions of the panels P, in such a way that the said electrodes E are activated selectively according to the dimensions of the panels to be painted and their spatial positioning in the painting machine. The electrodes E of the solution of FIGS. 2 and 2A can be mounted on motorized sliders S so that they move, under the control of the processor L, transversely or longitudinally with respect to the belt T, for example as shown by the arrows F1 and F2, in order to automatically match their positions to the changes in the dimensions and positioning on the belt of the panels P to be painted. There is no reason why the movability F2 in the longitudinal direction should not be used to make the electrodes E accompany the panel in its passage, with or without relative movement with respect to the conveyor T, and then return to operate correctly on the following panel. A similar alternative to this last solution is shown more fully in FIGS. 3 and 3*a*, in which the electrodes E are shown to be mounted on conveyors M positioned under the upper run of the conveyor T and running in phase with the latter, in the same direction and at the same speed or with an exact degree of slip, in such a way that at least one electrode E is always positioned under the panel P which is passing on the said conveyor T, in such a way that the electrode is always at the correct distance from the edges of the said panel. The electrodes of the conveyors M are connected to the power source K by means of sliding collectors Y or other suitable collectors whose nature will be evident to those skilled in the art. A plurality of conveyors M can be provided adjacently to each other and means can be provided to enable the transverse positioning of the said conveyors with respect to the main belt T to be modified automatically with changes in the dimensions of the panels to be painted, again under the control of the processor L.

Figure 5:
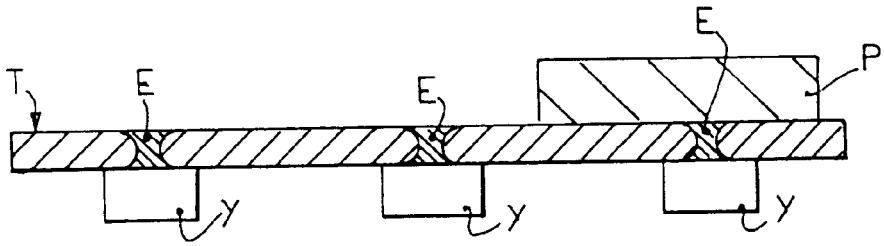
FIGS. 5 and 6 show a cross section through the conveyor of the solution of FIGS. 4 and 4*a*, in different possible embodiments.
Figure 6:
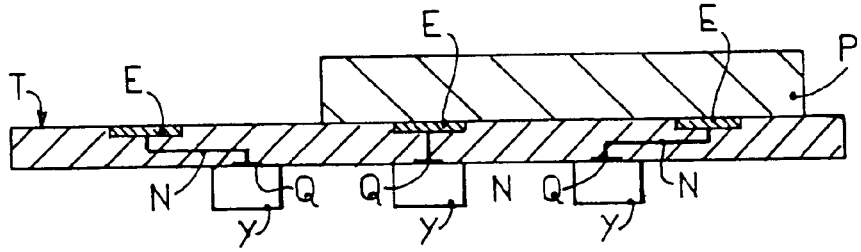
Figure 4:
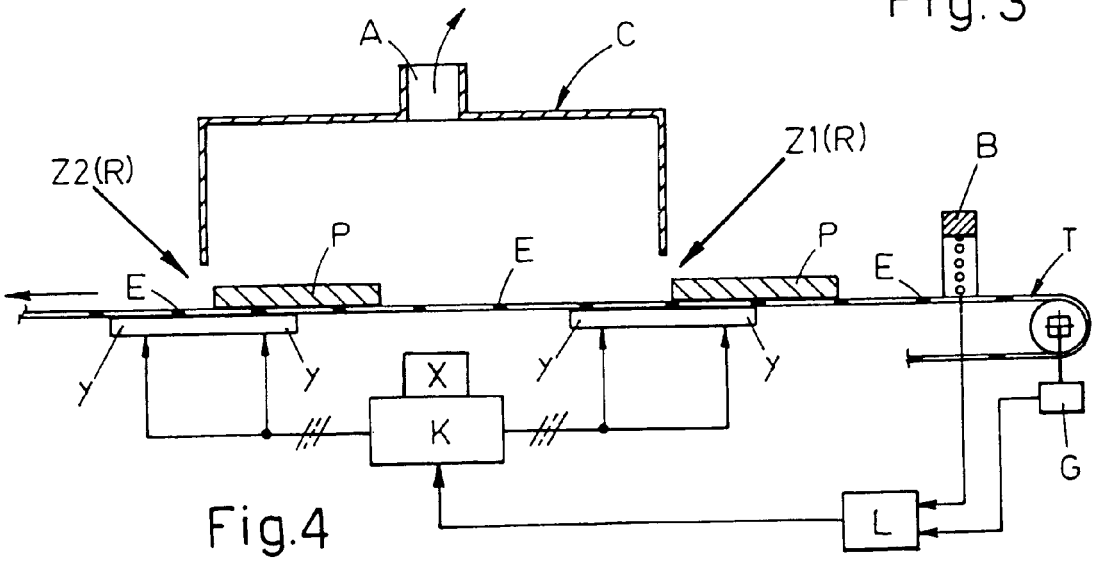
Figure 4A:
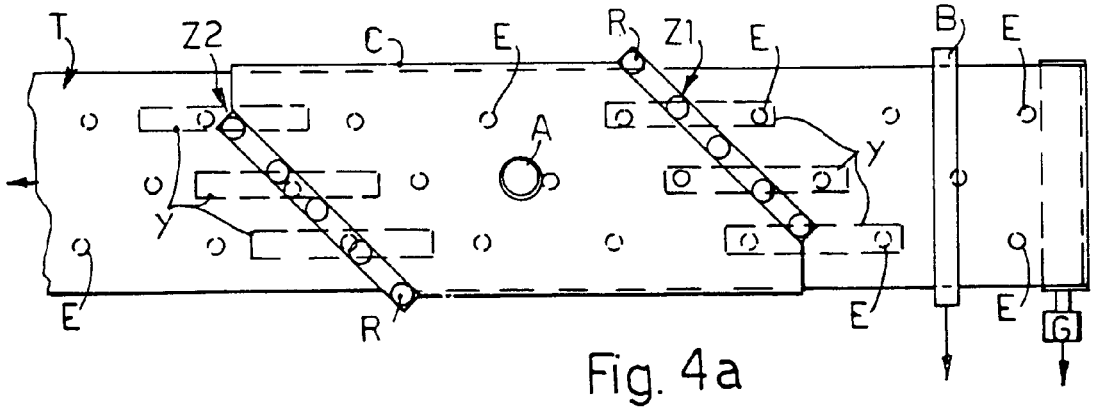

In the solution shown in FIGS. 4 and 4*a*, the electrodes E are integral with the conveyor T, move with the latter and with the panels P to be painted, and receive the requisite power by interaction with collectors Y, of the fixed type for example, connected to the switching point K for selective power supply. The electrodes E can be, for example, of the type illustrated in detail in FIG. 5, incorporated in the thickness of the conveyor T, and made for example from metal or conductive rubber, with their upper ends exposed in such a way that they touch the panel P and with their lower ends interacting with the collector Y by sliding along it. In the other solution shown in FIG. 6, the electrode E can be made from conductive rubber or metal, is fixed on the upper face of the conveyor T by any means in such a way that it touches the panel P directly or through a small protective element which provides structural continuity to the visible face of the conveyor T while also facilitating the cleaning of the conveyor, and the said electrode is connected to an electrically protected conductor N inside the conveyor T, connected to a contact Q fixed on the lower face or to another suitable point of the conveyor T, the contacts Q of the various electrodes being aligned in a plurality of tracks for interaction with corresponding collectors Y, in such a way as to provide a selective power supply to the electrodes according to the dimensions of the panels to be painted. There is no reason why, in the solution considered above, the collectors Y should not be movable instead of fixed, or arranged to move in a reciprocating way in the direction of the length of the conveyor T.

In the examples illustrated in FIGS. 2, 3, 4 and 2*a*, 3*a*, 4*a*, it is assumed that the electrodes E operate at least at the entry door Z1 and exit door Z2 of the paint chamber C, where the paint guns R operate, but it is to be understood that, possibly for the purposes of simplifying the construction of the machine, the range of activity of the electrodes can be wider and distributed over a larger area than that shown, up to the point where they act on the whole or practically the whole length of the upper run of the conveyor T (see below).

Figure 7:
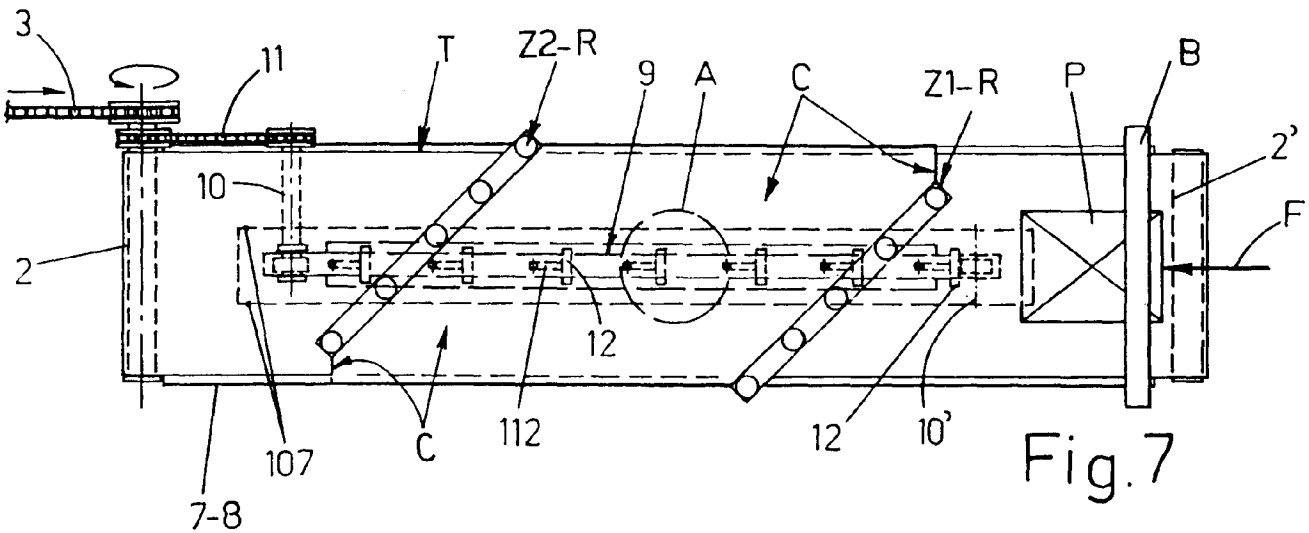
FIG. 7 is a schematic plan view of the painting machine in a version with movable electrodes.

Further improvements to the machine according to the invention will now be illustrated with reference to FIGS. 7 to 18. In FIG. 7, the letter T indicates the horizontal belt conveyor on which the panels P to be painted are arranged, this conveyor running on end rollers 2 and 2', one of which is connected to a motive power source 3 which makes the said conveyor advance, for example, in the direction indicated by the arrow F, with a continuous movement and at a specified speed. The panels P pass through the optoelectronic barrier B or other suitable means which, as stated above, detects its dimensions and its position in space and which controls the operation of the means for electrostatically charging the said panels and the starting and stopping of the operation of the electrostatic paint guns R which operate at the entry and exit doors Z1, Z2 of the paint chamber C.

For the resolution of the problem relating to the electrostatic charging of the panels P to be painted, even where these are made from MDF or other material with high electrical resistivity, good results have been obtained by using a belt conveyor T formed from a polyester fabric core impregnated with polyurethane and coated with polyurethane on the upper face at least, so that it has a perfectly smooth outer surface which is particularly suitable for cleaning by mechanical and pneumatic means of known types (not shown) which operate at the position of the return roller 2. The total thickness of the belt T is approximately 0.8 mm, inclusive of the polyurethane layer which is approximately 0.2 mm.

Figure 12:
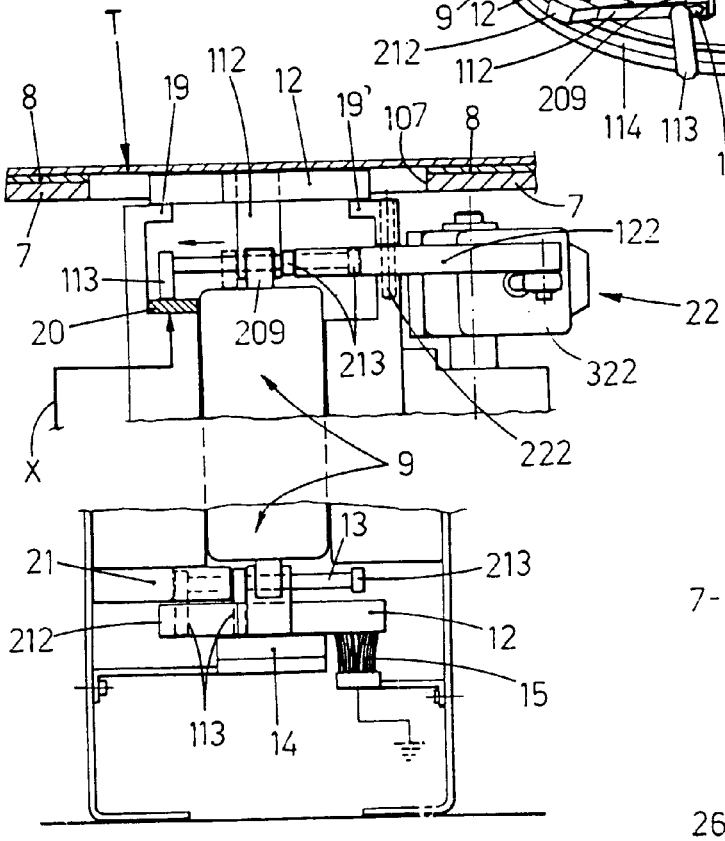
FIG. 12 is a front elevation of the initial end of the electrode conveyor, viewed in the direction of the arrow H in FIG. 10.
Figure 11:
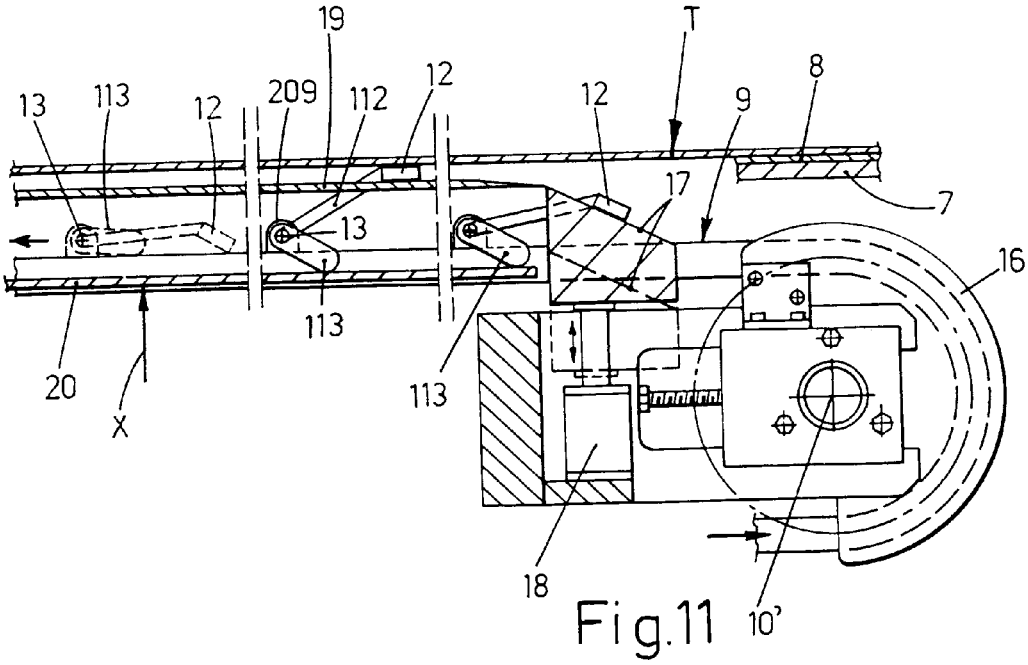
FIG. 11 shows other details of the conveyor of FIG. 8, in a section taken along the line XI—XI.

FIGS. 7, 11, and 12 show how the upper run of the conveyor T slides along and is supported by a horizontal bed 7 supported by the frame of the machine and having a longitudinal aperture 107 which leaves free the corresponding longitudinal strip of the said conveyor T on which the electrodes for polarizing the panels P are designed to act, as described above. Good results have been obtained by making the bed 7 from polypropylene and/or any other electrically insulating material which has a resistivity greater than that of MDF. The direct friction of the belt T on the polypropylene 7 bed gave rise to charges which caused unpredictable behaviour of the paint powder deposited on the said conveyor belt T. This problem was overcome by placing between the polypropylene surface 7 and the belt T a sheet 8 of the material used to form the said belt T, fixed in a convenient way on the underlying surface 7.

Figure 8:
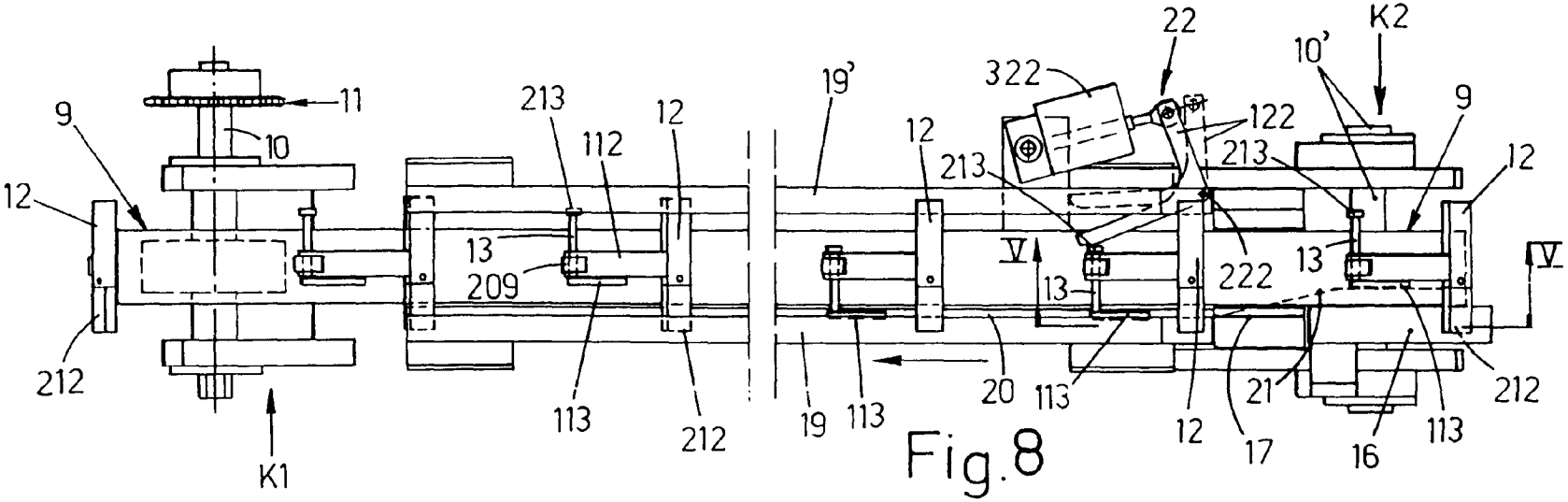
FIG. 8 is a plan view from above of the upper run of the conveyor with the electrodes of the machine of FIG. 7.
Figure 9:
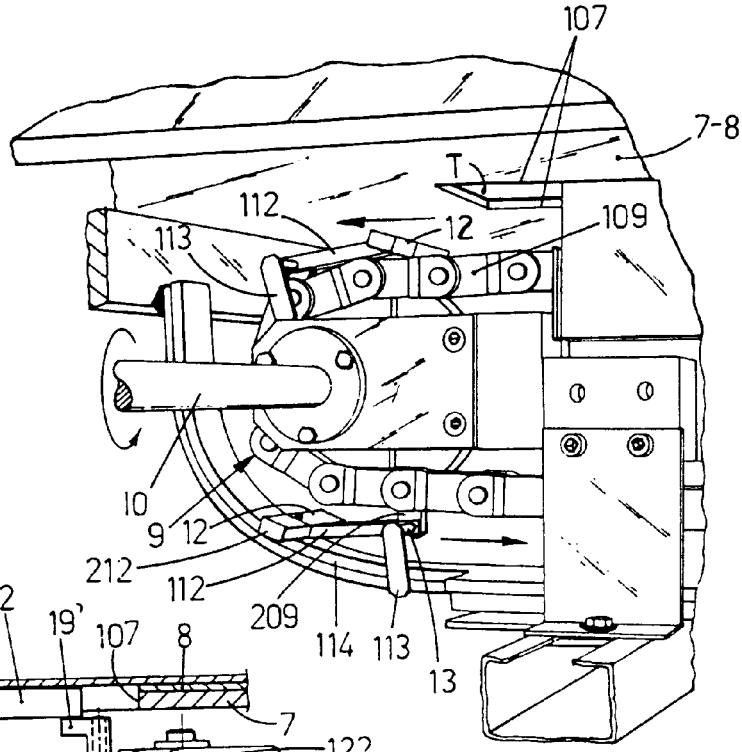
FIGS. 9 and 10 are perspective views of the final and initial ends respectively of the conveyor of FIG. 8, seen from the sides indicated by the arrows K1 and K2 respectively.
Figure 10:
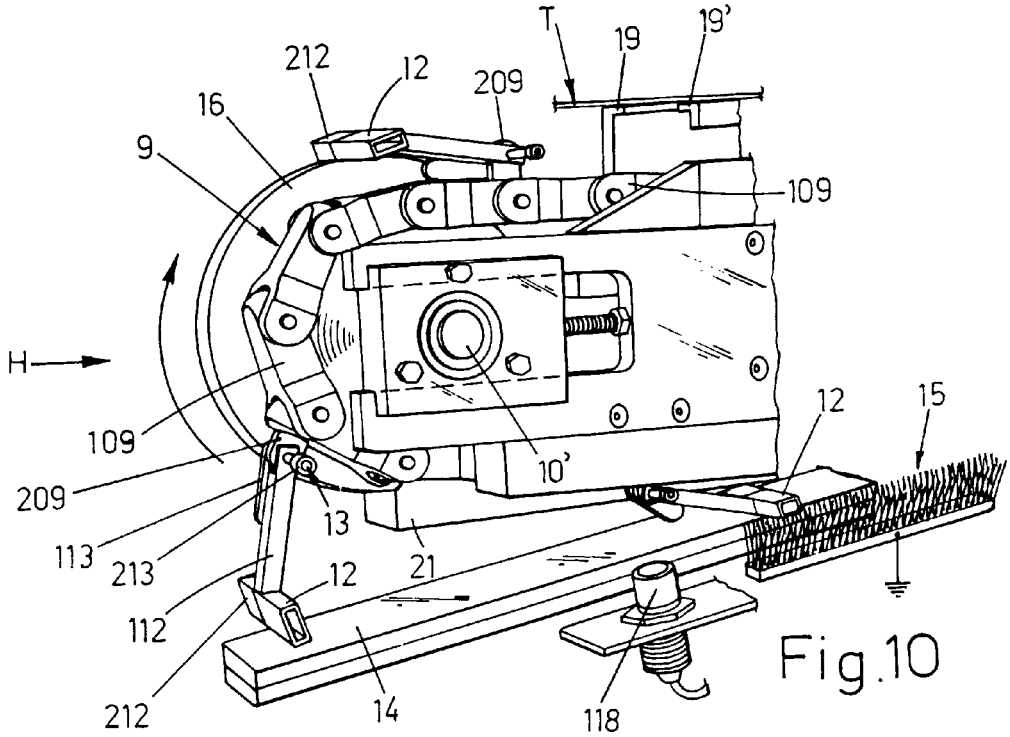

FIGS. 7 to 12 show how a rectilinear conveyor 9, aligned longitudinally with the conveyor T and having the shafts 10 and 10' of its return sprockets horizontal and parallel to the shafts 2 and 2', operates in the aperture 107 of the bed 7. The shaft 10 is connected by a positive transmission of motion 11 to the motive power source 3, in such a way that these conveyors T and 9 move in the same direction F and at the same speed. In a variant construction which is not shown, the longitudinal axis of the conveyor 9 can be slightly inclined with respect to that of the conveyor T. The conveyor 9 is formed from a chain of links 109 (FIGS. 9 and 10) of electrically insulating material, which carry, at constant intervals which are preferably decimal, for example of the order of approximately ten to twenty centimetres, projecting appendages 209, also made from electrically insulating material, on which are pivoted the forked ends of metal levers 112, each of which carries a head 12 forming an integral part of the lever and positioned transversely at the opposite end, this head 12 forming the actual electrode for polarizing the panels, which is also made from metal, is formed for example from a length of a tubular metal shape with a rectangular cross section, having dimensions of approximately 20×10×65 mm and orientated in such a way that, as it passes along the upper run of the conveyor 9, if the electrode is in the high position and active, the said head 12 touches the lower face of the conveyor T uniformly with one of its larger faces measuring 65×20 mm. The lever 112 is pivoted on the supporting appendage 209 by means of a metal pin 13 which is freely rotatable (see below), and which carries a small lever 113, integral with the appendage or rotatable, at one end, this lever constantly tending to point downwards under the action of gravity or of elastic means. FIGS. 9, 10 and 12 show how, as the electrodes 12 travel along the lower run of the conveyor 9, they slide along a fixed guide 14 whose area in contact with the said electrodes is made from electrically insulating material, the curved end portion 114 of this guide (FIG. 9) collecting the electrodes as they leave the upper run of the conveyor 9, in order to prevent them from swinging in an unnecessary and dangerous way and to position the said electrodes so that in the final part of their inactive travel they interact with a metallic brush 15 which is connected to earth and which discharges any residual potential difference from them. Each electrode 12 carries on at least one end an integral skid 212 of electrically insulating material with a low coefficient of friction, which, during the return to the end shaft 10' of the conveyor 9, interacts with a fixed guide in the form of a sector of a circle 16 (FIG. 11) which keeps the electrodes away from the links of the chain of the said conveyor, to ensure that these links are free to move relatively to each other. FIG. 9 shows how an inclined-plane cam 17 is provided in the initial part of the upper run of the conveyor 9, forming a continuation of the curved guide 16, this cam being transferable by an actuator 18 from the raised position indicated in solid lines to the lowered position indicated in broken lines, at the command of the processor which controls the operation and which, additionally using the data received from the barrier B, determines whether or not the electrodes cyclically reaching the high position are to be activated. A sensor 118 visible in FIG. 10 detects the phase of the electrodes and transmits this useful information to the aforesaid processor. If an electrode 12 is to be activated, the cam 17 is in the high position and interacts with the end skid 212 of the electrode which reaches it, this electrode being progressively raised and brought into contact with the lower face of the belt T. Immediately downline from the cam 17 in the high position there is provided the initial part, tapered to form a suitable lead-in, of a linear guide 19, preferably made from electrically insulating material, which is fixed to the frame of the conveyor in question, parallel to the longitudinal axis of the said conveyor, and which keeps the electrode in contact with the conveyor belt T. FIG. 12 shows how another fixed guide 19', also made from electrically insulating material with a low coefficient of friction, is preferably provided opposite and parallel to the guide 19, the electrodes 12 sliding and bearing directly on the guide 19' in order to ensure that these components are positioned in a perfectly horizontal way with a uniformly distributed constant contact with the conveyor T above them. It is to be understood that, in a variant construction which is not shown, the end of each electrode 12 designed to interact with the fixed guide 19' can also be provided with a skid of electrically insulating material with a low coefficient of friction, similar to the skid 212. It is also to be understood that rollers can be provided in place of these skids for a rolling interaction with the said guides 19 and 19'.

If, on the other hand, one of the electrodes 12 must not operate in contact with the belt T, then when this component leaves the curved guide 16 the cam 17 is in the low position shown in broken lines in FIG. 11, and therefore the electrode 12 continues to bear on the electrically insulating links of the conveyor chain 9, as shown in broken lines on the left of the said FIG. 11. The electrode in the low position is at a distance from the conveyor T which can be sufficient to prevent any effects on the panels P above it, even if the said electrode is live. During its travel along the upper run of the conveyor 9, the lever 113 pivoted on the fulcrum pin 13 of the lever with the electrode 12 is orientated downwards by gravity, and its rounded end bears on and slides along a linear metal collector 20, which is located under the aforesaid guide 19 and fixed on the electrically insulating section forming this guide, and which is connected to the electrical generator for polarizing the electrodes, shown schematically in FIGS. 11 and 12 by the arrow X. The generator X can generate a continuous voltage which can vary, for example, from 0 to 100 kV, with a useful value of approximately 60 kV and a current measurable in microamperes, for example approximately 500 A.

Since the distance of the electrodes 12 in the low inactive position, shown in broken lines on the left of FIG. 11, might be insufficient to neutralize the electrical effects of the said electrodes on the panels above them, provision has been made for the selective control of the contact of the levers 113 with the polarization collector 20, only in the case of the electrodes which are to be active. For this purpose, the pins 13 are axially movable and each has a head 213 at the opposite end from the lever 113. FIGS. 8, 10 and 12 show how, before leaving the lower run of the conveyor 9, the end of each pin 13 carrying the lever 113 which has previously left a stage of interaction with the upper collector 20 interacts with a linear fixed cam 21 of electrically insulating material, which forces the said pins to move axially and thus bring the lever 113 closer to the supporting appendage 209, so that, on their curved trajectory around the end shaft 10' of the conveyor 9, all the levers 113 bear on the links 109 of this conveyor, and when they reach the upper branch are located on a trajectory which is out of alignment with the linear collector 20 and is at a sufficient distance from it (FIGS. 8 and 12). The same figures show how there is provided in the initial part of the upper run of the conveyor 9 an exchange device 22 which, when commanded by the processor controlling the machine, axially moves the pins 13 of only those electrodes which are to continue in the high active position, the lever 113 of these pins being moved to the trajectory on which the polarization collector 20 lies. The exchange device comprises a right-angled lever 122 pivoted at 222 on a vertical axis and connected to an oscillation actuator 322 which, on command, can move the said lever from the resting position shown in broken lines, in which it does not interfere with the pins 13, to the active position shown in solid lines, in which one arm of this lever is inclined so that it interferes with the heads 213 of the pins 13 to subject them to the necessary axial movement for activating the corresponding contact lever 113.

Figure 13:
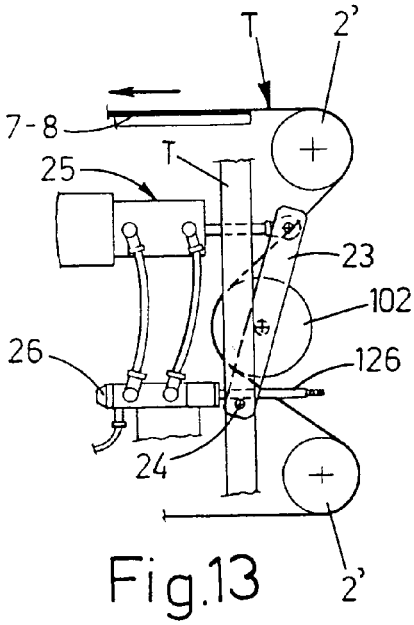
FIG. 13 is a side elevation of the details of the idle guide and return rollers of the conveyor belt of the painting machine.

Since the conveyor belt T is very thin, it is highly flexible and relatively elastic, and is therefore sensitive to the resistances which it encounters during its advance, which are not balanced and symmetrically distributed, so that the said conveyor tends to slip sideways and means are required to keep it automatically on track. FIG. 13 shows how these means comprise the running of one end of the belt T, preferably the driven end, over a pair of static parallel rollers 2', one above the other, supported rotatably by the fixed frame 1 of the machine, and over a third roller 102 located between the preceding ones (or down-line from the roller 2') and parallel to these, such that the belt T is made to form a re-entrant bend. The roller 102 is mounted rotatably with each of its ends on the intermediate part of a lever 23 which has one end pivoted at 24 on the fixed frame 1 of the machine and the other end connected to an oscillation actuator 25, of the pneumatic type for example, coupled to a command circuit with the interposition of a unit 26 having a feeler 126 which senses the position in space of the side of the conveyor T next to the lever 23. If the conveyor T slips outwards, it causes the feeler 126 to bend outwards and consequently causes the switching of the unit 26 which temporarily retracts the rod of the actuator 25 on a predetermined path which returns the conveyor T to its track. The pressure on the feeler 126 is progressively reduced, causing the unit 26 to switch again so that the actuator 25 returns to the resting position.

It is to be understood that, if the belt conveyor T has a width such that it can accommodate panels of considerable width, a plurality of conveyors 9 with the corresponding electrodes 12 can be positioned side by side and in a parallel arrangement under the upper run of the said conveyor T, and means will be provided to selectively operate these conveyors 9 or their electrodes 12, according to the dimensions of the panels to be painted.

In the painting machine with fixed electrodes, as shown in FIGS. 2 and 2*a*, it is assumed that the polarization electrodes E are located only at the entry and exit doors of the paint chamber, where the paint spray guns operate. Practical tests have shown that, in order to ensure uniformity and stability of coverage of the panel with the paint, it is preferable for the panel to remain suitably polarized by the electrodes for the whole of its passage through the paint chamber. For this purpose, in a painting machine with a conveyor T having the characteristics described above, with an upper run sliding on a horizontal bed 7–8 having the characteristics described above, but able to be structurally continuous, without the aforesaid longitudinal aperture 107, the electrodes E are fixed on this bed and are positioned at isolated points aligned in at least one row having a length suitably greater than that of the paint chamber C and aligned with the longitudinal axis of this chamber, as in the example shown in FIG. 14. The electrodes are suitably spaced apart from each other, for example at intervals of 5 to 20 times, for example approximately 10 times, the height of the edges of the panels to be painted. In the variant shown in FIG. 15, the row of electrodes E can be positioned with a slight inclination with respect to the longitudinal axis of the conveyor T, for example with an inclination in the range from 0° to 15°, for example approximately 7°, in such a way that the electrodes are placed progressively in different positions with respect to the edges of the panels, to ensure a correct and uniform coverage of the panels with paint. Also for this purpose, the electrodes E can be positioned differently on the vertices of a broken line which forms an alternating wave as in the case of FIG. 16, with the horizontal axis suitably inclined with respect to the longitudinal axis of the conveyor T, in such a way that the said electrodes have a wider spatial distribution than that shown in FIG. 15.

It is to be understood that, if the machine with fixed electrodes is to operate on very wide panels, a plurality of rows of electrodes can be positioned side by side, with a distance between the electrodes of one row and those of the neighbouring row not less than the distance between the electrodes in a single row and/or with any necessary staggering between the electrodes of one row and those of the adjacent row. The various rows of electrodes are connected to selective activating means, controlled for example by the entry barrier B, in such a way that they are activated selectively and automatically in accordance with the dimensions of the panels P to be painted.

The detail in FIG. 17 shows how the electrodes E can be made in the form of screws with flat countersunk heads, with hexagonal sockets, and with shanks of suitable diameter, from 5 to 15 mm for example, fixed in holes formed in the bed 7, in such a way that the flat faces of their heads are positioned to be coplanar with the upper face of the said bed 7, as in the case indicated by E and shown on the left of FIG. 17, or coplanar with the covering 7 of the said bed and thus essentially in contact with the lower face of the conveyor T, as in the case indicated by E' and shown on the right of FIG. 17. The shank of each of the screws forming the electrodes projects beneath the bed 7, interacts with a fixing nut and can be connected in any suitable way to the polarization generator. Good results have been obtained by permanently connecting all the electrodes of one row to the polarization generator. However, better results have been obtained by modulating the activation and inactivation of the electrodes of each row, according to the variations of the position above them of the panel to be painted, which moves continuously, in such a way that the electrodes, when activated, are never at critical distances from or too close to the edges of the panels. For this purpose, as shown in FIG. 14, the electrodes can be connected selectively to the polarization source X through a switch unit K controlled by a processor unit L which receives from the barrier B and from an encoder G the data relating to the dimensions and speed, and therefore to the position in space, of the panels to be painted. The switch unit K can comprise static electronic switches, or can control dynamic switches, consisting for example of small cylinder and piston units 27 as shown in the detail of FIG. 17, located under the screws which form the electrodes E, having their rods aligned and orientated against these screws and holding, with the interposition of an insulating support, an electrical contact 28 connected to the polarization unit X. In this case, the cylinders 27 are operated selectively, through a suitable interface, by the process unit L shown in FIG. 14, the whole system being understandable and easily constructed by persons skilled in the art.

Finally, in painting machines of the type under discussion, it has been found that the powdered paint deposited on the conveyor may fly upwards at the discharge end of the support bed 7–8, owing to the perturbation of an electrostatic equilibrium caused by the interruption of the said bed and/or unfavourable ambient atmospheric conditions and/or the characteristics of the various paint powders used from time to time, thus adversely affecting the correct placing of the paint on the edges of the painted panel, particularly on the front and rear edges. To overcome this problem, use can be made of the solution shown schematically in FIG. 18, in which the terminal part T' of the conveyor T is inclined downwards and continues to be supported by the bed 7, 8. Above this final inclined portion T' of the conveyor T there is provided a wedge-shaped conveyor 29 of suitable material, whose upper run is coplanar with and immediately consecutive to the horizontal run of the said conveyor T and which advances in such a direction and at such a speed that it collects and removes the painted panel, the whole being arranged in such a way as to overcome the aforesaid problems. Suitable means, not shown, are provided to clean the paint off the conveyor 29 as well.

The invention claimed is:

1. Equipment for preparing for electrostatic painting three-dimensional articles with a predominantly flat extension, made from dielectric or low-conductivity material, said equipment comprising:

a horizontal conveyor made from an electrically insulating material, having a resistivity greater than that of the articles to be painted; and one or more electrodes placed in isolated positions, at suitable distances from each other and from the edges of the articles, under the articles, at least while powdered paints electrostatically charged to an electrical potential are being fed on to them, said one or more electrodes emitting an electrical field with characteristics such that the electric field charges the whole visible surface of the articles, as far as their area of contact with the horizontal conveyor, to an electrical potential of opposite sign to that of the powdered paints, in such a way that the powdered paints completely and uniformly cover the visible surface of the articles, said one or more electrodes being of any suitable shape for their intended purpose and positioned under an upper run of the horizontal conveyor, the thickness of the horizontal conveyor being reduced in order to cause the least possible attenuation of the electrical field generated by said one or more electrodes which are located at least near one or more painting units and can be connected selectively to an electrical generator through at least one switching unit, in such a way that the one or more painting units can be activated selectively, at least in accordance with the dimensions in plan view of the articles to be painted.

2. The equipment according to claim 1, wherein said horizontal conveyor is made from a sufficiently porous material, permeable to air but not to paint powders.

3. The equipment according to claim 2, further comprising suction means to collect and remove dust from a lower return run of the horizontal conveyor which may be displaced by a jet of pressurized air which passes through said return run.

4. The equipment according to claim 1, wherein at least a part of said horizontal conveyor in contact with the articles to be painted is made from a material whose resistivity is greater by at least one order of magnitude than that of the articles.

5. The equipment according to claim 4, wherein said horizontal conveyor comprises a belt comprising polyethylene.

6. The equipment according to claim 1, wherein the one or more electrodes for polarizing the articles to be painted is located at a distance from the edge of the articles which is greater than 0.5 to 4 times the height of the edge of the articles to be painted.

7. The equipment according to claim 1, wherein the one or more electrodes for polarizing the articles to be painted is located at a distance from the edge of the articles which is not more than 5 to 20 times the height of the edge of the articles.

8. The equipment according to claim 1, wherein when the shape of the articles is such that the articles have to be acted on by a plurality of said one or more electrodes, the distance between the plurality of electrodes is not less than 5 to 20 times the height of the edge of the articles.

9. The equipment according to claim 1, wherein the one or more electrodes are fixed with a precise distribution to the conveyor so that they are as close as possible to or directly in contact with the articles to be painted, and are connected, by means of extensions or by means of electrical conductors connected to them, to corresponding fixed contacts connected to a lower face and/or to the edges of the horizontal conveyor, where said contacts are distributed in rows for interaction with power supply collectors which are supplied selectively, according to the dimensions of the articles to be painted, by at least one of the at least one switching units connected to an electrical generator.

10. The equipment according to claim 9, wherein said collectors and the switching and power supply units are fixed.

11. The equipment according to claim 9, wherein said collectors are movable with forward and return reciprocating movements in the direction of the movement of the articles to be painted.

12. The equipment according to claim 1, wherein the one or more electrodes are mounted on motorized sliders by means of which their position can be adjusted in space, for better adaptation to the dimensions in plan view of the articles to be painted.

13. The equipment according to claim 1, wherein the one or more electrodes are fixed.

14. The equipment according to claim 1, wherein the one or more electrodes are mounted on structures by means of which said one or more electrodes can be given a cyclical forward and return movement in the direction of the movement of the articles to be painted.

15. The equipment according to claim 14, wherein said means of movement are means of reciprocating rectilinear movement.

16. The equipment according to claim 14, wherein said means of movement are means of continuous movement of a closed conveyor and the one or more electrodes are connected to one of the at least one switching units and the electrode generator by means of collectors having a sliding contact.

17. The equipment according to claim 1, wherein means are provided for controlling the operation of the one or more electrodes in accordance with the dimensions and the positioning in space of the articles to be painted and these means comprise one of the at least one switching units connected to the electrical generator and controlled by a processor which receives information on the dimensions of the articles from optoelectronic means located up-line from a paint chamber and which receives from an encoder information on the speed of advance of the horizontal conveyor, said means being provided to enable said processor to operate with access to the information on the position in space of any moment of the articles to be painted.

18. The equipment according to claim 1, wherein said horizontal conveyor comprises a conveyor belt having a thickness which is restricted as much as possible and being in the range from 0.5 to 3 mm.

19. The equipment according to claim 18, wherein said conveyor belt comprises a polyester fabric core, impregnated with polyurethane material, and coated at least on its upper face with polyurethane material, in such a way that it has a perfectly smooth outer surface which is suitable for cleaning with mechanical and pneumatic means which operate on a return run of the conveyor belt.

20. The equipment according to claim 19, wherein the polyurethane coating is approximately 0.2 mm thick.

21. The equipment according to claim 18, wherein said conveyor belt comprises an upper run which slides on and is supported by a flat horizontal bed supported by a frame of said equipment, said bed comprised of an electrically insulating material, which has a resistivity greater than that of the articles to be painted and which is coated on the face in contact with said conveyor belt with at least one sheet of the same material as that of the conveyor belt.

22. The equipment according to claim 18, wherein said one or more electrodes are mounted at equal distances from each other and in such a way that they can be activated and de-activated, on one or more rectilinear closed conveyors, said rectilinear conveyors made from electrically insulating material, positioned longitudinally under an upper run of said conveyor belt move in the same direction and at the same speed as said horizontal conveyor, and have a length such that they follow the articles positioned above them throughout a painting cycle.

23. The equipment according to claim 22, wherein said one or more rectilinear conveyors takes its motion from a transmission system which also drives said belt of said horizontal conveyor.

24. The equipment according to claim 21, further comprising a bed supporting the upper run of said horizontal conveyor, said bed having at least one longitudinal aperture which leaves free the portion of the said horizontal conveyor on which the one or more electrodes for polarizing the articles to be painted can act by contact.

25. The equipment according to claim 21, further comprising one or more rectilinear conveyors—which carry said one or more electrodes, said one or more rectilinear conveyors is formed from a chain of links of electrically insulating material, which carry, at constant intervals, projecting appendages made from electrically insulating material, on which are pivoted, by their forked ends, metal levers each of which carries integrally and transversely on its other end, a metal head which forms the actual electrode for polarizing the articles, said metal levers being pivoted on said supporting appendages by means of a freely rotatably metal pin which has at one end a small lever which terminates in a rounded end and which is constantly orientated downwards by gravityor by the action of suitable means and which while travelling along the upper run of one of the one or more rectilinear conveyors, slides on a linear metal collector connected to said electrical generator for the necessary polarization of the one or more electrodes.

26. The equipment according to claim 22, wherein said one or more electrodes attached to said one or more rectilinear conveyors are spaced apart from each other on the order of 10 to 20 cm.

27. The equipment according to claim 25, wherein said metal head is formed from a length of tubular section with a rectangular cross section, orientated in such a way that, as it travels along the upper run of said one or more rectilinear conveyors, if the electrode is to be in the high active position, said metal head uniformly touches a lower face of said horizontal conveyor with one of its larger faces.

28. The equipment according to claim 25, wherein said one or more electrodes have approximately the following dimensions: 20×10×65 mm.

29. The equipment according to claim 25, further comprising under the lower run of said one or more rectilinear conveyors and parallel to it, a fixed guide, made from electrically insulating material at least in its upper part and having a curved initial portion for collecting said one or more electrodes leaving the upper run of one of the one or more rectilinear conveyors, said fixed guide having the function of preventing said one or more electrodes from oscillating in an unnecessary and dangerous way along the return path, and positioning said one or more electrodes correctly for interaction with a metal brush connected to ground for eliminating any residual voltage on said one or more electrodes before their return to the upper run of said one or more rectilinear conveyors.

30. The equipment according to claim 25, wherein said one or more electrodes carry on at least one end an integral skid made from electrically insulating material and with a low coefficient of friction, which, during the movement of said one or more electrodes, interacts with guide means which place said one or more electrodes correctly in the active or passive position in which they contact or do not contact the upper run of said horizontal conveyor.

31. The equipment according to claim 25, further comprising a fixed cam in the form of a sector of a circle and coaxially with a return shaft of said one or more conveyors, said fixed cam interacting with an end skid of said one or more electrodes which, as a result of this interaction, are kept away from said links, to ensure that said links have a freedom of relative movement on a curved path around said return shaft.

32. The equipment according to claim 25, further comprising an inclined plane cam located proximate start of the upper run of said one or more rectilinear conveyors, said inclined plane cam being transferable by an actuator from a high position to a low position at the command of a processor which controls operation of said equipment, said processor acting on the basis of the data received from an optoelectronic barrier which detects the dimensions of the articles to be painted on entry into said equipment and on the basis of data received from a sensor which detects the phase of the one or more electrodes, decides whether said one or more electrodes cyclically reaching the upper position are to be activated or not, and therefore whether said inclined plane cam is to be in the high or low position respectively.

33. The equipment according to claim 32, wherein said start of the upper run is suitably tapered to form a lead-in, of a first linear guide and provided down-line from a movable inclined plane cam when the latter is in a high position, said linear guide being fixed to the frame of one of the one or more rectilinear conveyors, parallel to said one of the one or more rectilinear conveyors, end skids of said one or more electrodes rising on to and sliding along said guide and thus being raised and kept in contact with said horizontal conveyor, a second fixed guide having a low coefficient of friction, being provided opposite said first linear guide and parallel thereto, the other ends of said one or more electrodes sliding and bearing directly, or with the interposition of an additional skid, on said second guide, and thus advancing with a uniformly distributed and constant contact with said horizontal conveyor above them.

34. The equipment according to claim 32, wherein if the said inclined plane cam is in the low position, said one or more electrodes advance in the low position, each in contact with a link of the corresponding one of said rectilinear conveyors, in a position suitably distant from said horizontal conveyor.

35. The equipment according to claim 25, further comprising pivot pins of said metal levers carrying said one or more electrodes and carrying at their ends the small levers for making contact with the linear collector for polarizing said one or more electrodes, are axially movable and each is provided, at the opposite end from the small levers with a head, and means are provided for changing the position in space of these pins, to ensure that only the small levers of each electrode which is to be in a high active position touches said collector, while the levers of each electrode in a low and inactive position follows a path to one side of and distant from the said collector, so that the corresponding electrodes are not polarized.

36. The equipment according to claim 35, wherein before leaving the lower run of one of said rectilinear conveyor, the small levers of each pivot pin of said one or more electrodes which has previously left a stage of interaction with said collector interacts with a linear fixed cam made from electrically insulating material, which forces said pivot pin to move axially so that the small levers are brought closer to said projecting appendages, in such a way that all the small levers which are leaving the lower run of one of said rectilinear conveyors and which are about to rise to the upper run are positioned on the links of this conveyor and consequently to one side of and distant from the position in space occupied by said collector.

37. The equipment according to claim 36, further comprising, at the start of the upper run of said one or more rectilinear conveyors, an exchange device which, at the command of a processor, moves axially the pivot pins of only those one or more electrodes which are to remain in the high active position, in such a way that the small levers of these pins move along a trajectory of interaction with the collector.

38. The equipment according to claim 37, wherein said exchange device comprises a right-angled lever pivoted on a vertical axis and connected to an oscillation actuator which, when commanded, can move said right-angled lever from the-fest inactive position, in which it does not interfere with the pivot pins of the one or more electrodes, to the active position in which one arm of said right-angled lever is inclined so that it interferes with the heads of said pins, to subject them to the axial movement which causes the corresponding small lever to interact with the collector of the one or more electrodes.

39. The equipment according to claim 18, wherein said one or more electrodes for polarizing the articles to be painted are fixed on a bed which supports the upper run of the horizontal conveyor and are positioned at isolated points located one after the other in at least one row whose length is suitably greater than the length of a paint chamber and which is orientated along the longitudinal axis of said chamber.

40. The equipment according to claim 39, wherein a row of one or more electrodes can be positioned with a slight inclination in the range from 0° to 15° with respect to the longitudinal axis of the horizontal conveyor, in such a way that said one or more electrodes are arranged progressively in different positions with respect to the edges of the articles to be painted, to ensure that the articles are correctly and uniformly covered with paint.

41. The equipment according to claim 39, wherein said one or more electrodes can be positioned in different ways on the vertices of a broken line which forms an alternating wave, with horizontal axes suitably inclined with respect to the longitudinal axis of the horizontal conveyor, in such a way that said one or more electrodes are also widely distributed over the width of said horizontal conveyor for advancing the articles to be painted.

42. The equipment according to claim 39, wherein said one or more electrodes are suitably spaced apart from each other by distances of approximately 5 to 20 times the height of the edges of the articles to be painted.

43. The equipment according to claim 39, wherein said one or more electrodes can be made in the form of screws with flat countersunk heads, with hexagonal sockets, and with shanks of suitable diameter.

44. The equipment according to claim 43, wherein said screws are fixed in holes formed in said bed above which the upper run of the horizontal conveyor slides, in such a way that the flat faces of their heads are coplanar with the upper face of said bed.

45. The equipment according to claim 43, wherein said screws are fixed in holes formed in the bed and in a corresponding upper cover above which the upper run of the horizontal conveyor slides, in such a way that the flat faces of their heads are essentially in contact with the said horizontal conveyor for advancing the articles.

46. The equipment according to claim 39, further comprising means for ensuring that the one or more electrodes of each row are all constantly connected to a polarization generator.

47. The equipment according to claim 39, further comprising means for modulating the activation and inactivation of the one or more electrodes of each row in accordance with the variations of the positions above them of the articles to be painted, which moves continuously, in such a way that said one or more electrodes, in the active phase, are never active at critical distances or too close to the edges of the articles.

48. The equipment according to claim 47, wherein said one or more electrodes can be connected to a polarization source through one of the at least one switching units controlled by a processor unit which receives from an optoelectronic barrier and from an encoder data relating to the dimensions and speed and consequently to the position in space of the articles to be painted.

49. The equipment according to claim 48, wherein said switching unit comprises static electric switches.

50. The equipment according to claim 48, wherein said switching unit comprises dynamic switches comprising small cylinder and piston units, located under screws forming said one or more electrodes, having their rods aligned and orientated against said screws and holding, with the interposition of an insulating support, an electrical contact connected to said polarization source.

51. The equipment according to claim 39, wherein a terminal part of the horizontal conveyor has a downward inclination and continues to be supported by a bed while there is provided above said downward inclination, a wedge-shaped conveyor whose upper run is coplanar with and immediately consecutive to the horizontal run of said horizontal conveyor and advances in such a direction and at such a speed that it collects and removes the painted articles.

52. The equipment according to claim 51, further comprising means to clean paint from said wedge-shaped conveyor.

53. The equipment according to claim 1, further comprising a polarization generator for generating a continuous voltage which can vary from 0 to 100 kV, and with a current measurable in microamperes.

54. The equipment according to claim 18, further comprising automatic means to keep said conveyor belt correctly centered and guided on corresponding return rollers.

55. The equipment according to claim 54, wherein a driven end of said conveyor belt runs over a pair of parallel static rollers, one of said pair above the other, supported rotatably by a fixed frame of said equipment, and over a third roller which forces said conveyor belt to form a re-entrant bend and which is located between the said pair of parallel rollers or after said third roller and is parallel to these, but is mounted rotatably at each end on the intermediate part of a corresponding lever, one end of which is pivoted on the said fixed frame, and the other end of which is connected to an oscillation actuator connected to an operating circuit with the interposition of a unit having a feeler which senses the position in space of the side of the conveyor belt adjacent to said lever, the whole system being designed in such a way that if the conveyor belt moves outwards and causes said feeler to be bent outwards, the unit switches and causes the temporary retraction of a rod of said oscillation actuator through a predetermined distance which returns the conveyor belt to its track, causing a reduction of the force on said feeler and the switching back of said unit which returns the oscillation actuator to the resting position.

56. The equipment according to claim 22, wherein, if said conveyor belt has a width such that it can accommodate articles which may be of considerable width, where movable electrodes are used, a plurality of said rectilinear conveyors with corresponding one or more electrodes can be positioned side by side and in a parallel arrangement under the upper run of said horizontal conveyor, with a distance between the electrodes of one said rectilinear conveyor and those of the neighboring one of said rectilinear conveyors which is not less than that between the electrodes of each said rectilinear conveyors, and/or with the one or more electrodes of one said rectilinear conveyor staggered with respect to those of the neighboring rectilinear conveyor, and means are provided for selectively activating said rectilinear conveyors and/or the corresponding movable electrodes in accordance with the dimensions of the articles to be painted.

57. The equipment according to claim 39, wherein, if said conveyor belt has a width such that it can accommodate articles which may be of considerable width, where fixed electrodes are used, a plurality of rows of the one or more electrodes can be positioned side by side, with a distance between the electrodes of one row and those of the neighboring row not less than that between the one or more electrodes of each row, and/or with the one or more electrodes of one row staggered if necessary with respect to those of the adjacent row, and means are provided for selectively activating the rows of fixed one or more electrodes in accordance with the dimensions of the articles to be painted.

58. Equipment for preparing for electrostatic painting three-dimensional articles with a predominantly flat extension, made from dielectric or low-conductivity material, said equipment comprising:

a horizontal conveyor made from an electrically insulating material, having a resistivity greater than that of the articles to be painted; and one or more electrodes placed in isolated positions, at suitable distances from each other and from the edges of the articles, under the articles, at least while powdered paints electrostatically charged to an electrical potential are being fed on to them, said one or more electrodes emitting an electrical field with characteristics such that the electric field charges the whole visible surface of the articles, as far as their area of contact with the horizontal conveyor, to an electrical potential of opposite sign to that of the powdered paints, in such a way that the powdered paints completely and uniformly cover the visible surface of the articles, wherein the one or more electrodes are of any suitable shape for their intended purpose, are fixed with a precise distribution to the horizontal conveyor so that they are as close as possible to or directly in contact with the articles to be painted, and are connected, by means of extensions or by means of electrical conductors connected to them, to corresponding fixed contacts connected to a lower face and/or to the edges of the horizontal conveyor, where said contacts are distributed in rows for interaction with power supply collectors which are supplied selectively, according to the dimensions of the articles to be painted, by at least one switching unit connected to an electrical generator.

59. Equipment for preparing for electrostatic painting three-dimensional articles with a predominantly flat extension, made from dielectric or low-conductivity material, said equipment comprising:

a horizontal conveyor made from an electrically insulating material, having a resistivity greater than that of the articles to be painted, said horizontal conveyor having a thickness which is restricted as much as possible and is in the range from 0.5 to 3 mm, said conveyor comprising a conveyor belt comprising a polyester fabric core, impregnated with polyurethane material, and coated at least on its upper face with polyurethane material, in such a way that it has a perfectly smooth outer surface which is suitable for cleaning with mechanical and pneumatic means which operate on a return run of the belt; and one or more electrodes placed in isolated positions, at suitable distances from each other and from the edges of the articles, under the articles, at least while powdered paints electrostatically charged to an electrical potential are being fed on to them, said one or more electrodes emitting an electrical field with characteristics such that the electric field charges the whole visible surface of the articles, as far as their area of contact with the horizontal conveyor, to an electrical potential of opposite sign to that of the powdered paints, in such a way that the powdered paints completely and uniformly cover the visible surface of the articles.

60. Equipment for preparing for electrostatic painting three-dimensional articles with a predominantly flat extension, made from dielectric or low-conductivity material, said equipment comprising:

a horizontal conveyor made from an electrically insulating material, having a resistivity greater than that of the articles to be painted, said horizontal conveyor having a thickness which is restricted as much as possible and is in the range from 0.5 to 3 mm, said conveyor comprising a conveyor belt comprising an upper run which slides on and is supported by a flat horizontal bed supported by a frame of said equipment, said bed comprised of an electrically insulating material, which has a resistivity greater than that of the articles and which is coated on the face in contact with said conveyor belt with at least one sheet of the same material as that of the belt; and one or more electrodes placed in isolated positions, at suitable distances from each other and from the edges of the articles, under the articles, at least while powdered paints electrostatically charged to an electrical potential are being fed on to them, said one or more electrodes emitting an electrical field with characteristics such that the electric field charges the whole visible surface of said articles, as far as their area of contact with the conveyor, to an electrical potential of opposite sign to that of the powdered paints, in such a way that the powdered paints completely and uniformly cover the visible surface of the articles.

61. Equipment for preparing for electrostatic painting three-dimensional articles with a predominantly flat extension, made from dielectric or low-conductivity material, said equipment comprising:

a horizontal conveyor made from an electrically insulating material, having a resistivity greater than that of the articles to be painted, said horizontal conveyor having a thickness which is restricted as much as possible and being in the range from 0.5 to 3 mm; and one or more electrodes placed in isolated positions, at suitable distances from each other and from the edges of the articles, under the articles, at least while powdered paints electrostatically charged to an electrical potential are being fed on to them, said one or more electrodes emitting an electrical field with characteristics such that the electric field charges the whole visible surface of said articles, as far as their area of contact with the conveyor, to an electrical potential of opposite sign to that of the powdered paints, in such a way that the powdered paints completely and uniformly cover the visible surface of the articles, said one or more electrodes are mounted at equal distances from each other and in such a way that they can be activated and de-activated, on one or more rectilinear closed conveyors, said rectilinear conveyors comprising electrically insulating material, positioned longitudinally under an upper run of a belt of said horizontal conveyor, move in the same direction and at the same speed as said horizontal conveyor, and have a length such that they follow the articles positioned above them throughout a painting cycle.

62. Equipment for preparing for electrostatic painting three-dimensional articles with a predominantly flat extension, made from dielectric or low-conductivity material, said equipment comprising:

a horizontal conveyor made from an electrically insulating material, having a resistivity greater than that of the articles to be painted, said horizontal conveyor having a thickness which is restricted as much as possible and being in the range from 0.5 to 3 mm; and one or more electrodes placed in isolated positions, at suitable distances from each other and from the edges of the articles, under the articles, at least while powdered paints electrostatically charged to an electrical potential are being fed on to them, said one or more electrodes emitting an electrical field with characteristics such that the electric field charges the whole visible surface of said articles, as far as their area of contact with the conveyor, to an electrical potential of opposite sign to that of the powdered paints, in such a way that the powdered paints completely and uniformly cover the visible surface of the articles, said one or more electrodes for polarizing the articles to be painted are fixed on a bed which supports the upper run of the horizontal conveyor and are positioned at isolated points located one after the other in at least one row whose length is suitably greater than the length of a paint chamber and which is orientated along the longitudinal axis of said chamber.

* * * * *